US009523250B2

(12) United States Patent
Ness et al.

(10) Patent No.: US 9,523,250 B2
(45) Date of Patent: Dec. 20, 2016

(54) MIXING TANK AND METHOD OF USE

(76) Inventors: Danny Ness, Metairie, LA (US); Robert Bartlett, New Orleans, LA (US)

( * ) Notice: Subject to any disclaimer, the term of this patent is extended or adjusted under 35 U.S.C. 154(b) by 695 days.

(21) Appl. No.: 13/298,693

(22) Filed: Nov. 17, 2011

(65) Prior Publication Data

US 2012/0125615 A1 May 24, 2012

Related U.S. Application Data

(63) Continuation-in-part of application No. 12/948,517, filed on Nov. 17, 2010.

(60) Provisional application No. 61/261,995, filed on Nov. 17, 2009, provisional application No. 61/474,018, filed on Apr. 11, 2011.

(51) Int. Cl.
*E21B 21/06* (2006.01)

(52) U.S. Cl.
CPC ..... *E21B 21/062* (2013.01)

(58) Field of Classification Search
CPC ..... E21B 21/062
USPC ..... 166/75.15, 90.1; 175/207, 217; 222/394, 222/386.5, 387, 389, 94, 95, 105
See application file for complete search history.

(56) References Cited

U.S. PATENT DOCUMENTS

| | | | | |
|---|---|---|---|---|
| 2,579,655 | A | 12/1951 | Donald | |
| 2,683,010 | A | 7/1954 | Hamerslag, Jr. | |
| 3,776,435 | A | 12/1973 | Smith | |
| 3,916,803 | A | 11/1975 | Garcia | |
| 4,165,806 | A | 8/1979 | Cayton | |
| 4,403,556 | A | 9/1983 | Van Gompel | |
| 4,741,843 | A * | 5/1988 | Garvey et al. | 507/121 |
| 4,828,311 | A | 5/1989 | Hayashi | |
| 5,078,415 | A | 1/1992 | Goral | |
| 5,122,038 | A * | 6/1992 | Malkoski | 417/313 |
| 5,156,233 | A | 10/1992 | Olsen et al. | |
| 5,292,012 | A | 3/1994 | Davis | |
| 5,507,237 | A | 4/1996 | Barrow et al. | |
| 5,906,165 | A | 5/1999 | McCorkle, Jr. et al. | |
| 6,058,852 | A | 5/2000 | Estvanko | |
| 6,357,365 | B1 | 3/2002 | Higgins et al. | |
| 6,371,299 | B1 | 4/2002 | Essary | |
| 6,422,405 | B1 | 7/2002 | Haenszel | |
| 6,668,735 | B2 | 12/2003 | Cassina | |
| 6,725,783 | B2 | 4/2004 | Sekino | |
| 7,971,657 | B2 * | 7/2011 | Hollier et al. | 175/66 |

* cited by examiner

*Primary Examiner* — Robert E Fuller
(74) *Attorney, Agent, or Firm* — Garvey, Smith, Nehrbass & North, L.L.C.; Charles C. Garvey, Jr.; Vanessa M. D'Souza

(57) ABSTRACT

A method of transmitting a fluid into an oil well bore including the steps of providing a frame supporting a vessel, the vessel having an interior, upper and lower end portions, a conically shaped side wall, and an outlet for discharging the fluid from the vessel. Further including the steps of adding a viscous polymeric material to the vessel interior, placing a discharge pipe having a vertical section below the vessel wherein the discharge pipe is in communication with the outlet, placing a positive displacement pump within the discharge pipe wherein the pump transmits fluid from the outlet into the discharge pipe downstream of the vertical pipe section, and selectively transmitting fluid to either the vessel interior (for recirculating) or into the well. Air is added to the discharge flow line downstream of the pump. Preferably, the vessel contains a flexible bladder/bag that holds the material to be pumped.

18 Claims, 10 Drawing Sheets

MIXING TANK AND METHOD OF USE

CROSS-REFERENCE TO RELATED APPLICATIONS

In the US, this is a continuation-in-part of U.S. patent application Ser. No. 12/948,517, filed 17 Nov. 2010, which is a nonprovisional of U.S. Provisional Patent Application Ser. No. 61/261,995, filed 17 Nov. 2009, each of which are incorporated herein by reference, and priority of each of these applications is hereby claimed.

Priority of U.S. patent application Ser. No. 12/948,517, filed 17 Nov. 2010, incorporated herein by reference, is hereby claimed.

In the US, this is a nonprovisional of U.S. Patent Application Ser. No. 61/474,018, filed 11 Apr. 2011, which is incorporated herein by reference.

Priority of U.S. Provisional Patent Application Ser. No. 61/474,018, filed 11 Apr. 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a specially configured mixing tank for mixing and transferring a liquid or slurry into an oil well.

2. General Background

In the exploration of oil and gas in a marine environment, fixed, semi submersible, jack up, and other offshore marine platforms are used during drilling operations. Fixed platforms are typically used for production of oil and gas from wells after they have been drilled. Drilling and production require that specialized fluids and like supplies be transported from land based storage facilities to offshore platforms or drilling vessels. Supplies are typically transferred to offshore platforms using very large marine vessels called work boats. These work boats can be in excess of one hundred feet in length and have expansive deck areas for carrying cargo that is destined for an offshore platform. Supplies are typically transferred from a land based dock area to the marine vessel using a lifting device such as a crane, or a mobile lifting and transport device such as a forklift.

Once a work boat arrives at a selected offshore platform, supplies or products are typically transferred from the deck of the work boat to the platform using a lifting device such as a crane.

Once on the deck of a drilling platform or production platform, space is at a premium. The storage of supplies on an offshore oil well drilling or production platform is a huge problem. Some specialized fluids used in the well require handling that does not shear the fluid. An example is a high viscosity fluid such as certain polymers. Many cargo transport and lifting devices have been patented. The table below lists some patents that relate generally to pallets, palletized racks, and other cargo racks.

TABLE 1

| PAT. NO. | TITLE | ISSUE DATE MM-DD-YYYY |
|---|---|---|
| 2,579,655 | Collapsible Container | 12-25-1951 |
| 2,683,010 | Pallet and Spacer | 07-06-1954 |
| 3,776,435 | Pallet | 12-04-1973 |
| 3,916,803 | Loading Platform | 11-14-1975 |
| 4,165,806 | Palletizing System for Produce Cartons and the Like | 08-28-1979 |
| 4,403,556 | Drum Retainer | 09-13-1983 |
| 4,828,311 | Metal Form Pallet | 05-09-1989 |
| 5,078,415 | Mobile Carrier for Gas Cylinders | 01-07-1992 |
| 5,156,233 | Safety Anchor for Use with Slotted Beams | 10-20-1992 |
| 5,292,012 | Tank Handling and Protection Structure | 03-08-1994 |
| 5,507,237 | Lifting Apparatus for Use with Bulk Bags | 04-16-1996 |
| 5,906,165 | Stackable Tray for Plants | 05-25-1999 |
| 6,058,852 | Equipment Skid | 05-09-2000 |
| 6,357,365 | Intermediate Bulk Container Lifting Rack | 03-19-2002 |
| 6,371,299 | Crate Assembly and Improved Method | 04-16-2002 |
| 6,422,405 | Adjustable Dunnage Rack | 07-23-2002 |
| 6,668,735 | Pallet with a Plastic Platform | 12-30-2003 |
| 6,725,783 | Pallet for Stacking Planographic Printing Plates Thereon | 04-27-2004 |

BRIEF SUMMARY OF THE INVENTION

The present invention provides an improved mixer apparatus that includes a frame having upper and lower end portions. The frame supports a specially configured vessel and an internal mixer, pump and valving.

The present invention provides a method of transmitting a viscous polymeric fluid into an oil well bore. As part of the method, there is provided a frame supporting a vessel, the vessel having an interior, upper and lower end portions, a conically shaped side wall, and an outlet for discharging the fluid from the vessel.

A viscous material is added to the vessel interior.

A discharge pipe section is placed in communication with the outlet and at least in part below the vessel, the discharge pipe section being in communication with the outlet.

A positive displacement pump is placed in the discharge pipe section, the pump transmitting the fluid from the outlet into the discharge pipe downstream of the vertical pipe section.

There can be a selective transmitting of the fluid to either the vessel interior for recirculating or into the well.

Air can be added to the discharge flow line downstream of the pump.

In one embodiment, the pump includes screw conveyor.

In one embodiment, the conically shaped side wall extends to the outlet and placing the positive displacement pump entirely below the conically shaped side wall.

In one embodiment, the viscous polymeric material includes a fluid loss control product.

In one embodiment, the viscous material is a viscous polymeric material.

In one embodiment, the vessel gradually tapers downwardly to provide a larger upper portion and a smaller lower portion.

In one embodiment, a drive shaft rotates an auger that is inside the vessel.

In one embodiment, the drive shaft rotates both the screw conveyor and the auger.

In one embodiment, the pump includes a drive shaft that rotates the screw conveyor.

The present invention provides in one embodiment, a method of transmitting a viscous polymeric fluid into an oil well bore.

The method includes providing a frame supporting a vessel, the vessel having an interior, upper and lower end portions, a conically shaped side wall that tapers downwardly, and an outlet for discharging the fluid from the vessel.

The method includes adding a polymeric material to the vessel interior that is a fluid loss control product.

A discharge pipe section is placed below the vessel, the discharge pipe section being in communication with the outlet;

A positive displacement pump is placed in the discharge pipe, the pump transmitting the fluid from the outlet into the discharge pipe downstream of the vertical pipe section.

The fluid can be transmitted to either the vessel interior for recirculating or into the well.

In one embodiment, the pump has a drive shaft and the drive shaft extends into the vessel interior.

In one embodiment, the pump includes a screw conveyor.

In one embodiment, the conically shaped side wall extends to the outlet and placing the positive displacement pump entirely below the conically shaped side wall.

In one embodiment, the viscous material is a viscous polymeric material.

In one embodiment, air can be added (e.g. injected) to the discharge pipe section downstream of the outlet.

In one embodiment, the vessel gradually tapers downwardly to provide a larger upper portion and a smaller lower portion.

In one embodiment, a drive shaft rotates an auger that is inside the vessel.

In one embodiment, the drive shaft rotates both the screw conveyor and the auger.

In one embodiment, the pump includes a drive shaft that rotates the screw conveyor.

The present invention provides an apparatus for transmitting a viscous polymeric fluid into an oil well bore.

The apparatus includes a frame that supports a vessel, the vessel having an interior, upper and lower end portions, a conically shaped side wall, and an outlet for discharging the fluid from the vessel.

An opening in the vessel enables the addition of a viscous material to the vessel interior.

A discharge pipe section is in communication with the outlet and extending at least in part below the vessel, the discharge pipe section being in communication with the outlet.

A positive displacement pump is placed in the discharge pipe section, the pump transmitting the fluid from the outlet into the discharge pipe downstream of the vertical pipe section.

Piping enables selective transmission of the fluid to either: 1) the vessel interior for recirculating, or 2) into the well.

A source of air includes an air inlet fitting for enabling air to be added to the discharge flow line downstream of the pump.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
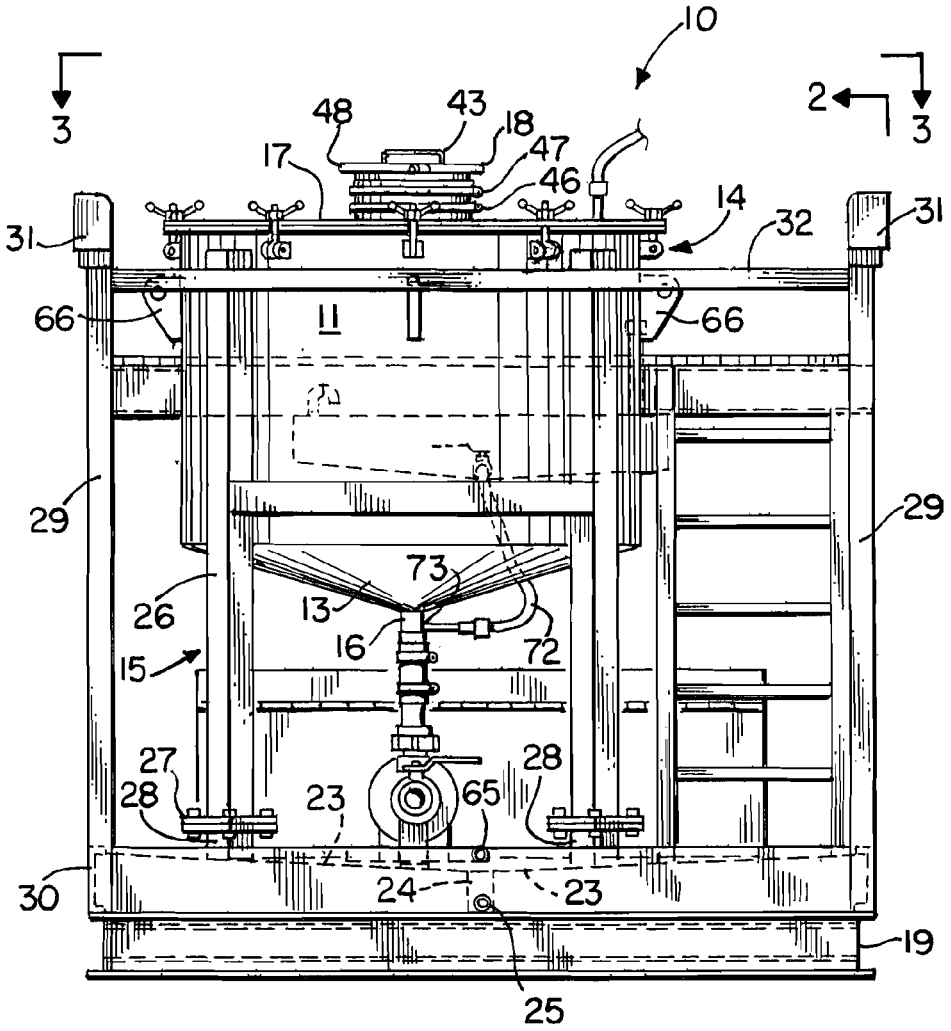
FIG. 1 is an elevation view of a preferred embodiment of the apparatus of the present invention.

FIGS. 1-8 show a preferred embodiment of the apparatus of the present invention designated generally by the numeral 10. Material dispensing apparatus 10 and its method contemplate the addition of a viscous and/or polymeric fluid into the well bore of an oil/gas well as part of well control. Such products can include fluid loss control products such as for example "Safe-Link" from MiSwaco (www.miswaco-.com).

In FIGS. 1-8, a vessel 11 is provided, supported upon frame 30. Vessel 11 has interior 12 that contains a viscous material to be dispensed. Vessel 11 has a tapered wall or cone 13. Vessel 11 has a larger upper end portion 14 and smaller lower end portion 15 due to the conical shape of the side wall or cone 13. The lower end portion 15 has an outlet 16 which enables fluid to be discharged from vessel 11 interior 12. A lid or cover 17 can be provided on upper end portion of vessel 11. Lid or cover 17 can be hingedly mounted upon upper end portion 14 of vessel 11. Handle/upper opening assembly 18 on lid or cover 17 enables a user to open or close the vessel 11 such as when adding fluid or material to vessel 11 interior 12 (see FIG. 6). Vessel 11 can be separated from frame 30 (see FIG. 10).

Figure 5:
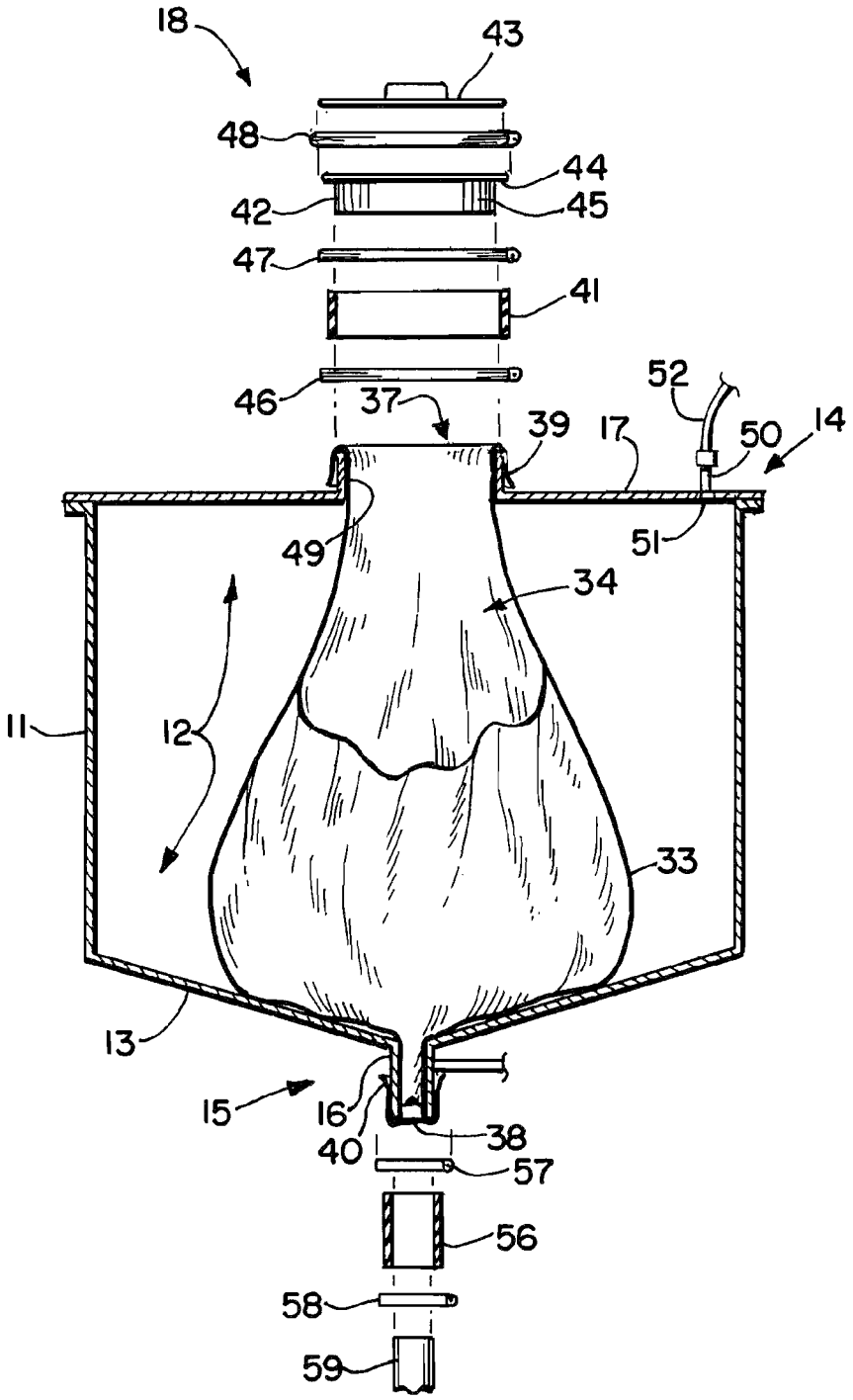
FIG. 5 is a partial sectional exploded view of a preferred embodiment of the apparatus of the present invention.
Figure 7:
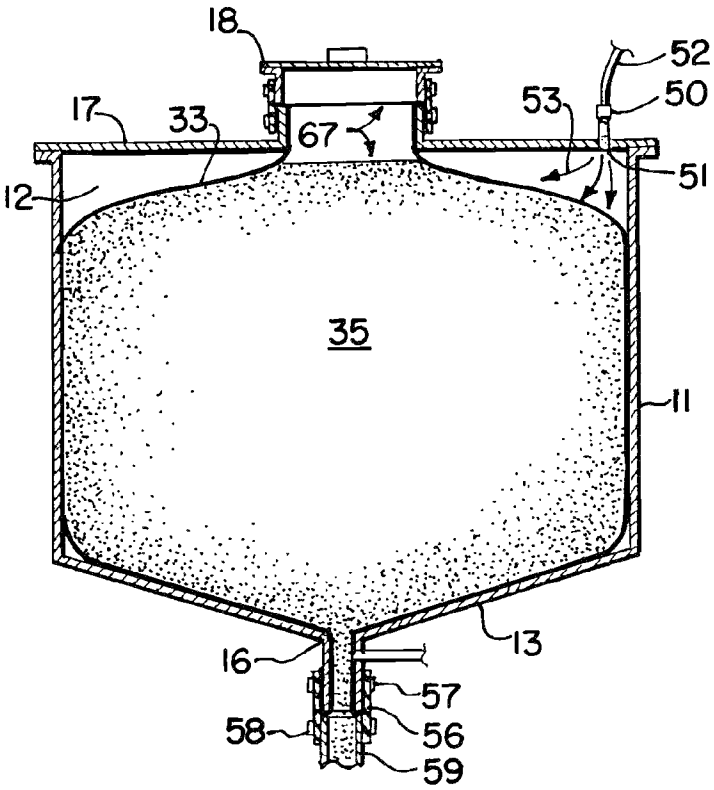
FIG. 7 is a partial sectional elevation view of a preferred embodiment of the apparatus of the present invention.
Figure 6:
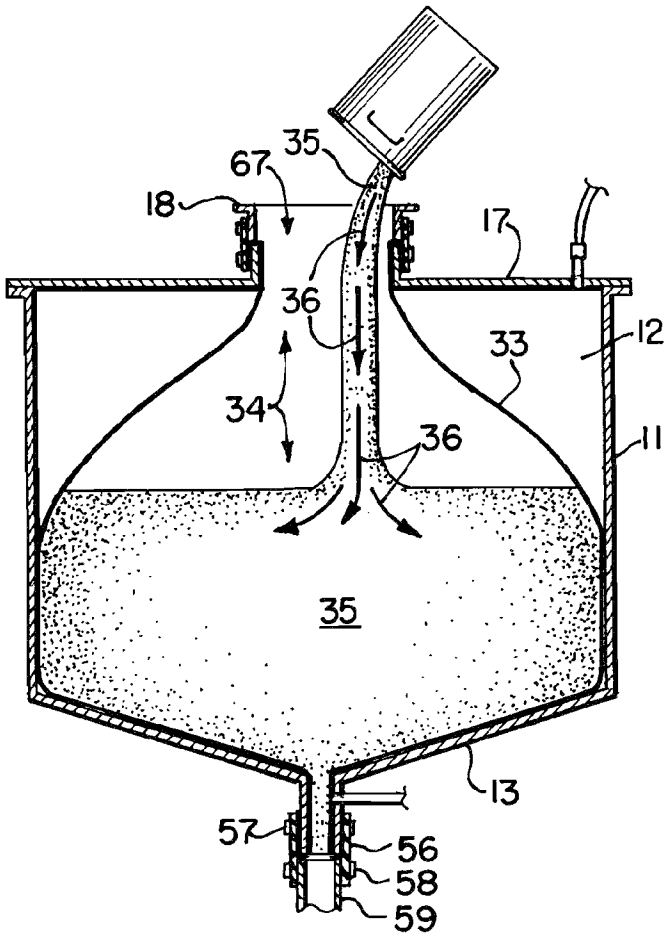
FIG. 6 is a partial sectional elevation view of a preferred embodiment of the apparatus of the present invention.

Upper opening assembly 18 enables access to the vessel 11 interior 12 as shown in FIGS. 5-7. The manway assembly 18 is shown in more detail in FIG. 5 in an exploded view. Frame 30 includes base 19 which can be constructed of a plurality of structural beams welded end to end such as, for example, I beams or channel beams. The base 19 supports four frame corner columns 29. Each corner column has an upper fitting 31 that enables one frame 30 to be stacked upon another frame 30 once vessel 11 has been removed. Each fitting 31 can be of welded steel or welded aluminum construction, such as welded plates 74, 75, 76, 77, 78 in FIG. 4. Plates 74, 76 have aligned openings 79 to provide a lifting point on each fitting 31 for the attachment of lifting rigging such as a shackle, sling, steel cable or the like. Forklift tine sockets 20, 21 enable the frame 30 to be lifted and transported using a forklift. Vessel 11 provides pad eyes 66.

Floor 22 can provide one or more inclined surfaces 23. Inclined surfaces 23 enable the collection of liquid material into sump 24 for removal via drain 25.

Vessel 11 can be supported by a plurality of legs 26. Flanged connections 27 enable each leg 26 to be quickly disconnected from a foot 28 by bolts 85.

Figure 2:
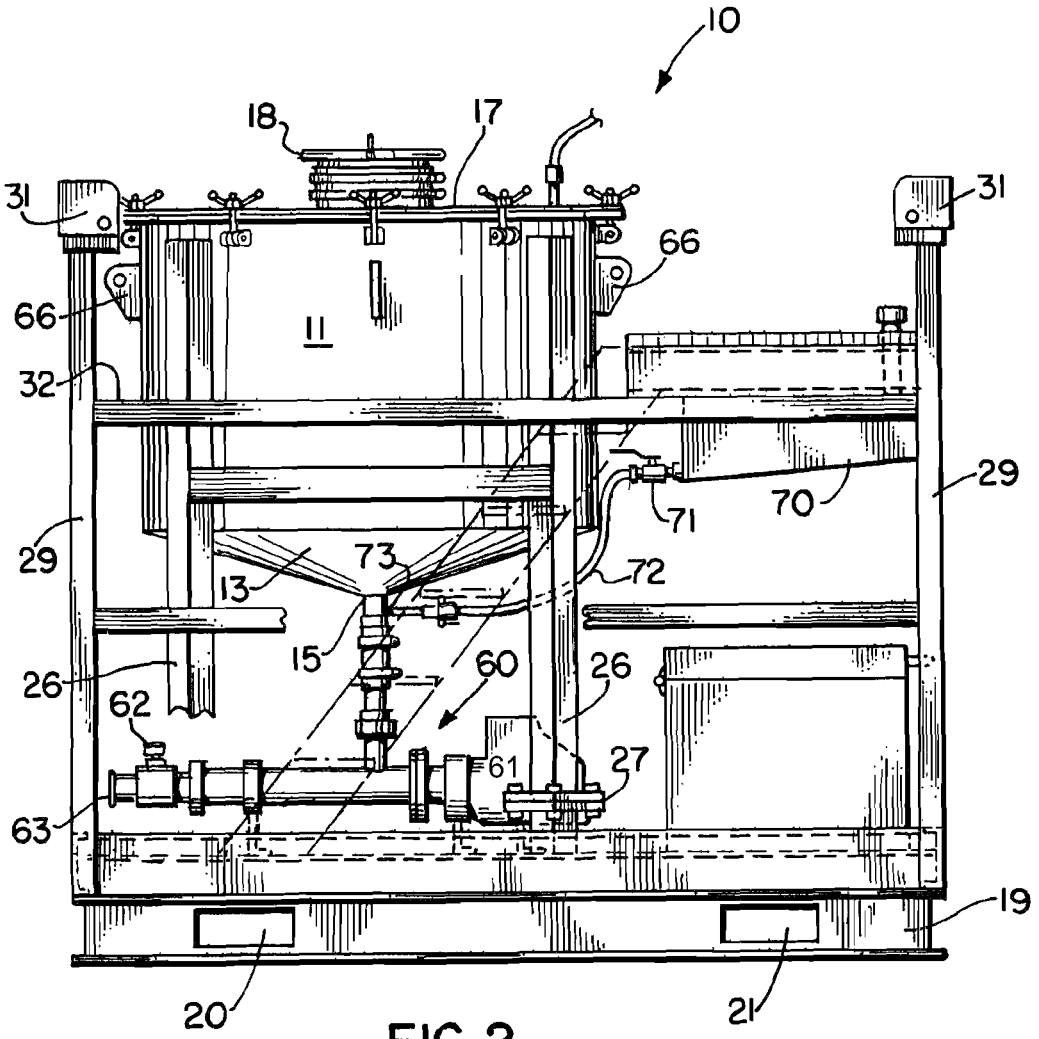
FIG. 2 is a side view of a preferred embodiment of the apparatus of the present invention taken along lines 2-2 of FIG. 1.
Figure 3:
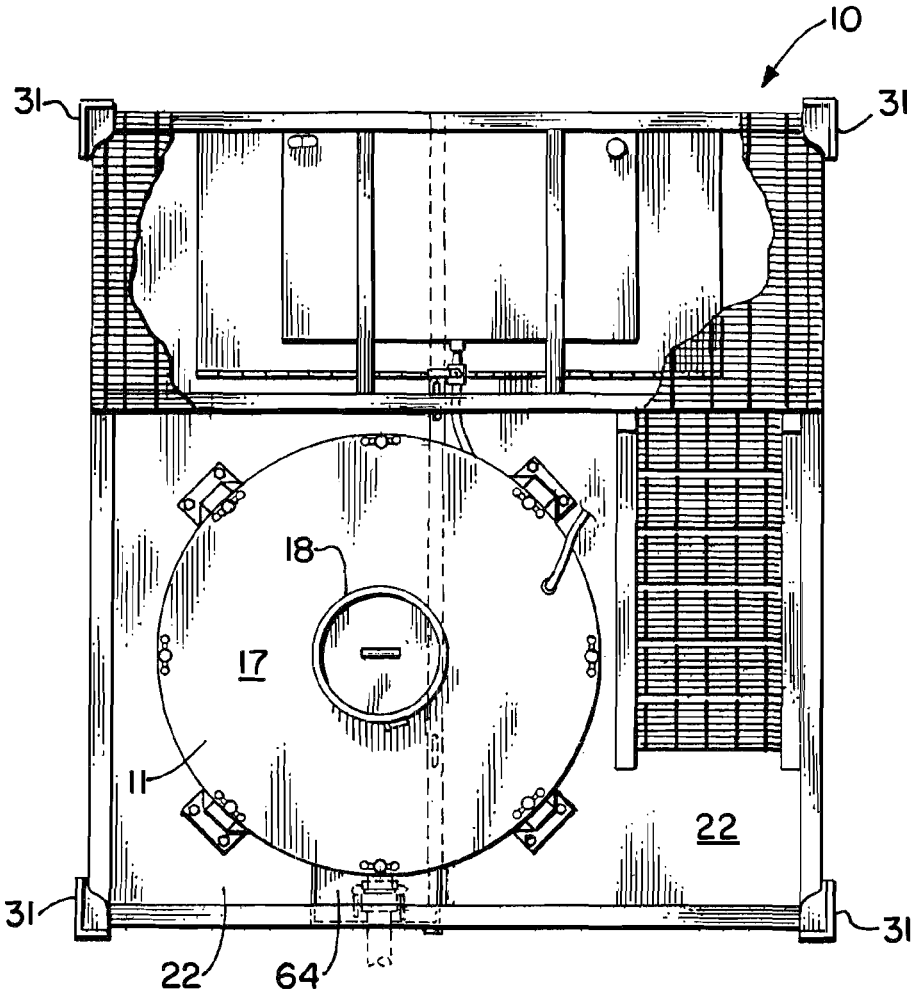
FIG. 3 is a top view of a preferred embodiment of the apparatus of the present invention taken along lines 3-3 of FIG. 1.
Figure 4:
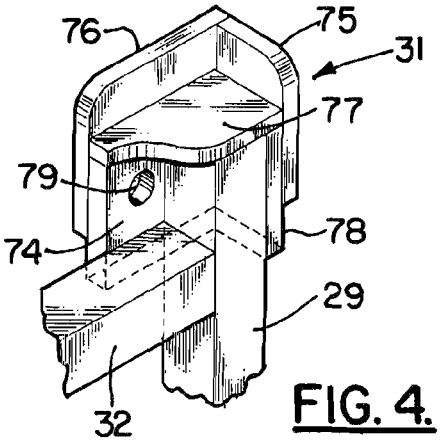
FIG. 4 is a fragmentary perspective view of a preferred embodiment of the apparatus of the present invention.

Upper beams 32 connect between an upper end portion between each frame corner column 29 and another corner column 29 as shown in FIGS. 1 and 2. The upper beams 32 are placed below fittings 31 as shown.

An inflatable vessel or bladder 33 is provided inside vessel 11 as shown in FIGS. 5-8. Inflatable vessel 33 has an interior 34 for containing the material 35 that is to be pumped. In FIG. 6, arrows 36 illustrate the addition of material 35 to interior 34 of inflatable vessel 33. The inflatable vessel has an upper opening 37 and a lower opening 38 as seen in FIG. 5. Inflatable vessel 33 has an upper edge 39 and a lower edge 40. These edges 39, 40 are each circular or continuous or endless. In order to form a connection between the inflatable vessel 33 and vessel 11, sleeves can be provided as shown in FIGS. 5-7. A connection of inflatable vessel 33 is made to annular wall 49 surrounding opening 67 of vessel 11 as shown in FIGS. 5-7. Upper edge 39 of inflatable vessel 33 is overlapped with the external surface of annular wall 49 as shown in FIG. 5. Lower sleeve 41 is then placed over this overlap of upper edge 39 with annular wall 49 as shown in FIGS. 5-7. The lower sleeve 41 can then be held in position using a plurality of clamps such as lower clamp 46 and upper clamp 47. An additional sleeve 42 is an upper sleeve. Upper sleeve 42 has cylindrical portion 45 and annular flange or shoulder 44. The cylindrical portion 45 fits inside of lower sleeve 41. Clamp 48 holds lid 43 to annular flange 44 as shown in FIGS. 5-7.

Figure 8:
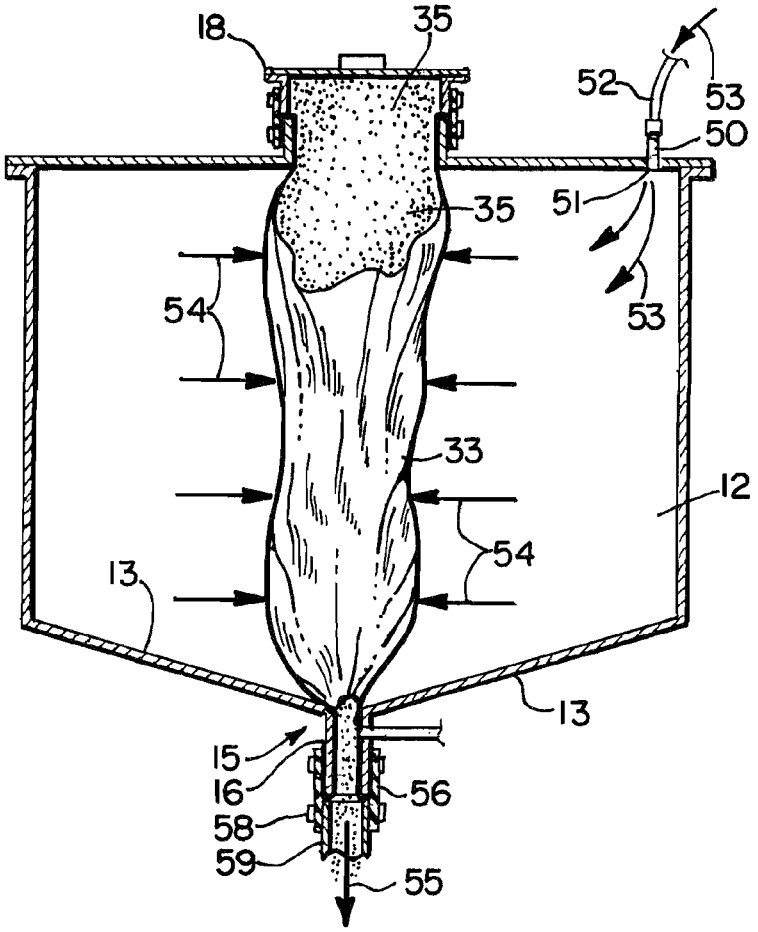
FIG. 8 is a partial sectional elevation view of a preferred embodiment of the apparatus of the present invention.

An air inlet fitting 50 and air inlet 51 enable compressed air to be supplied to vessel 11 interior 12 via flow line 52 (see arrows 53). Arrows 53, 54 in FIGS. 7-8 illustrate the injection of compressed air via flow line 52 and air inlet fitting 50 to air inlet 51 and vessel 11 interior 12. This introduction of compressed air forces material 35 contained within vessel 33 to be discharged from vessel 11 via outlet 16 at the lower end portion 15 of vessel 11 (see arrows 54, 55).

In FIG. 5, a connection is formed between lower edge 40 of inflatable vessel 33 and outlet 16. The lower edge 40 of inflatable vessel 33 overlaps outlet 16 as shown in FIG. 5. Sleeve 56 then fits over the combination of the lower end portion of inflatable vessel 33 and outlet 16 as shown in FIG. 5. Sleeve 56 can be held in position using one or more clamps 57, 58. Flow line 59 can be connected to the combination of outlet 16, inflatable vessel 33, sleeve 56 and clamps 57, 58 as shown in FIGS. 6 and 7. In FIG. 8, arrows 54 illustrate the compaction of inflatable vessel 33 under the force of pressure introduced to vessel 11 interior 12 via air inlet 51 as illustrated by arrows 53, 54 in FIG. 8.

Flow line or discharge 59 connects with header 60. A positive displacement pump with a screw conveyor is designated by the numeral 61. This pump or screw conveyor connects to header 60. Outlet valve 62 controls the flow of material 35 from header 60 to outlet 63 then to a desired discharge point. Catch basin 64 can be provided under outlet 63 to catch any spills or drips therefrom. Catch basis 64 can be provided with a drain 65.

Brine tank 70 has an outlet or valve 71 for controlling the flow of brine from tank 70 brine inlet 73. Flow lines 72 connects with brine inlet 73. If desired, brine can be injected to outlet 16, added to material 35 for enhancing the performance of the material 35 or its ability to flow.

Figure 9:
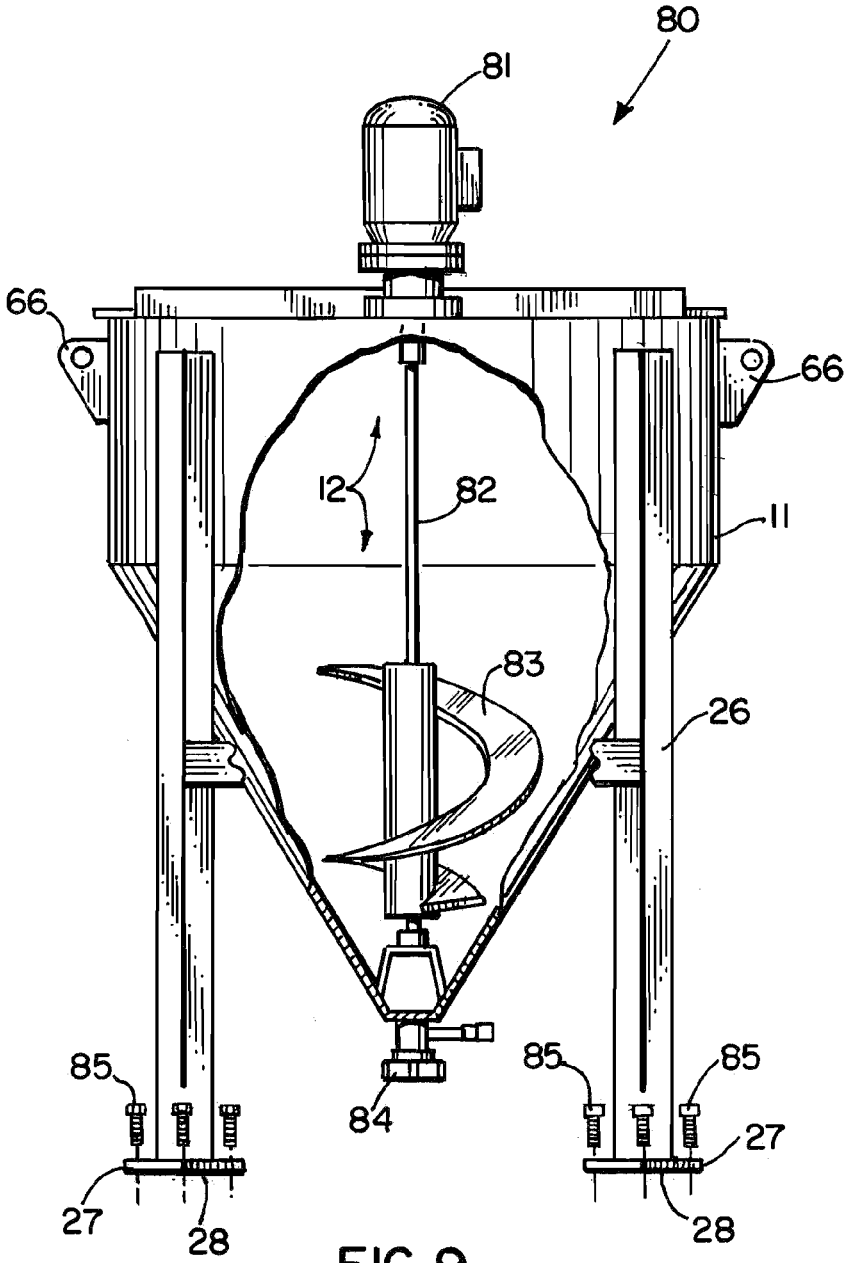
FIG. 9 is a sectional elevation view of an alternate embodiment of the apparatus of the present invention.
Figure 10:
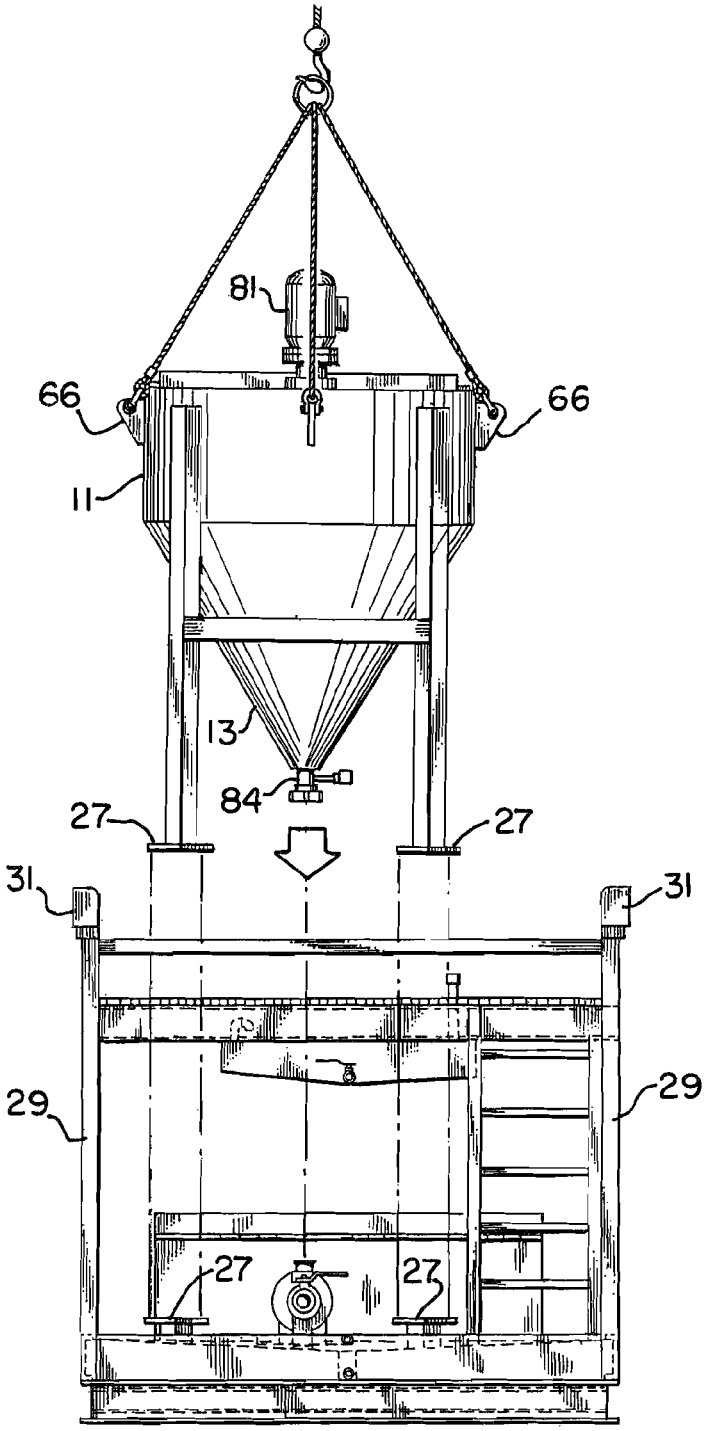
FIG. 10 is a sectional elevation view of an alternate embodiment of the apparatus of the present invention.
Figure 11:
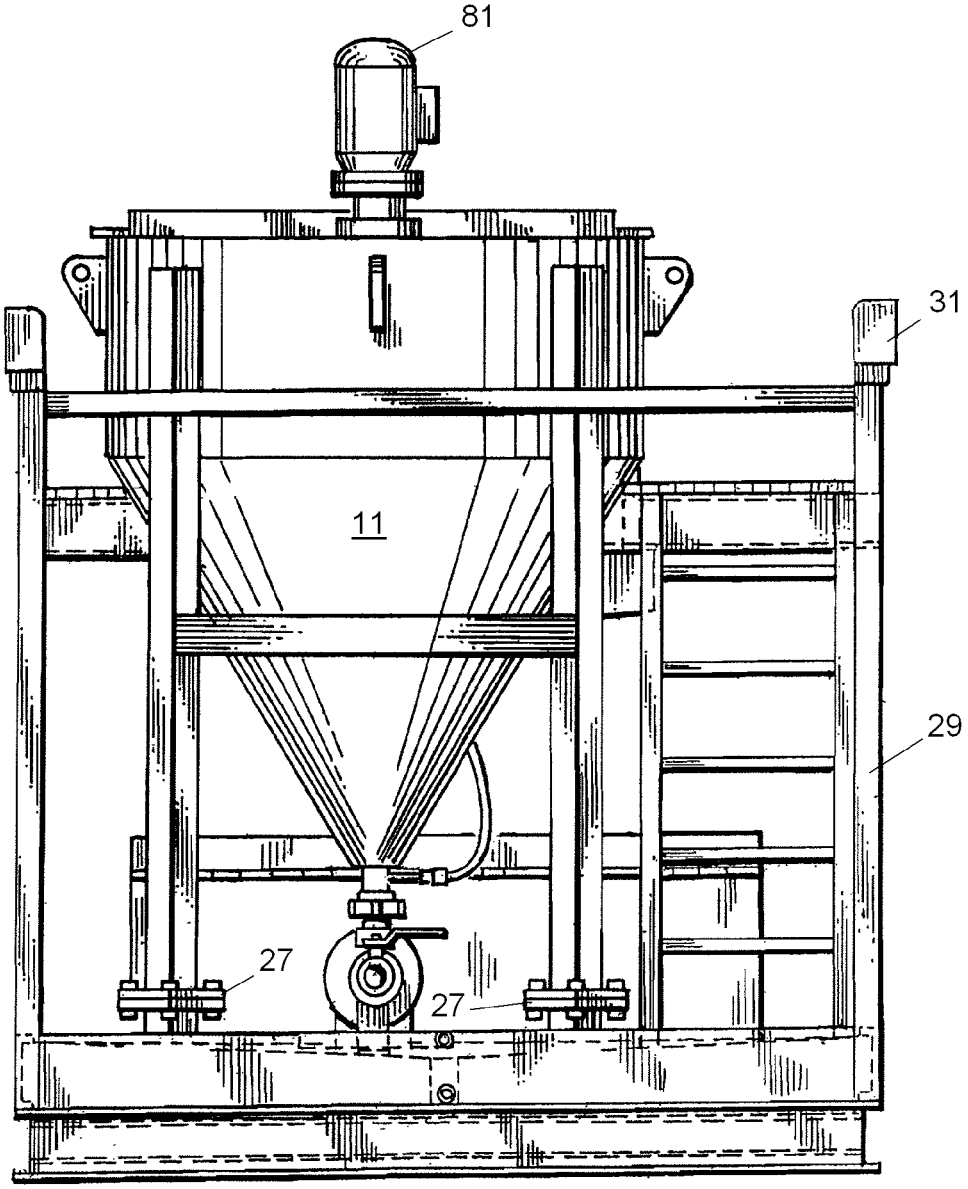
FIG. 11 is a sectional elevation view of an alternate embodiment of the apparatus of the present invention.

FIGS. 9-11 show an alternate construction for dispensing device designated by the numeral 80 wherein the tank 11 is provided with a motor drive 81, shaft 82 and auger 83 which replace the inflatable and deflatable vessel or bladder 33. The auger 83 is driven or rotated with drive shaft 82 and motor drive (e.g. electric, hydraulic) 81 to help force material 35 from the vessel 11 interior 12 through outlet 84.

Figure 12:
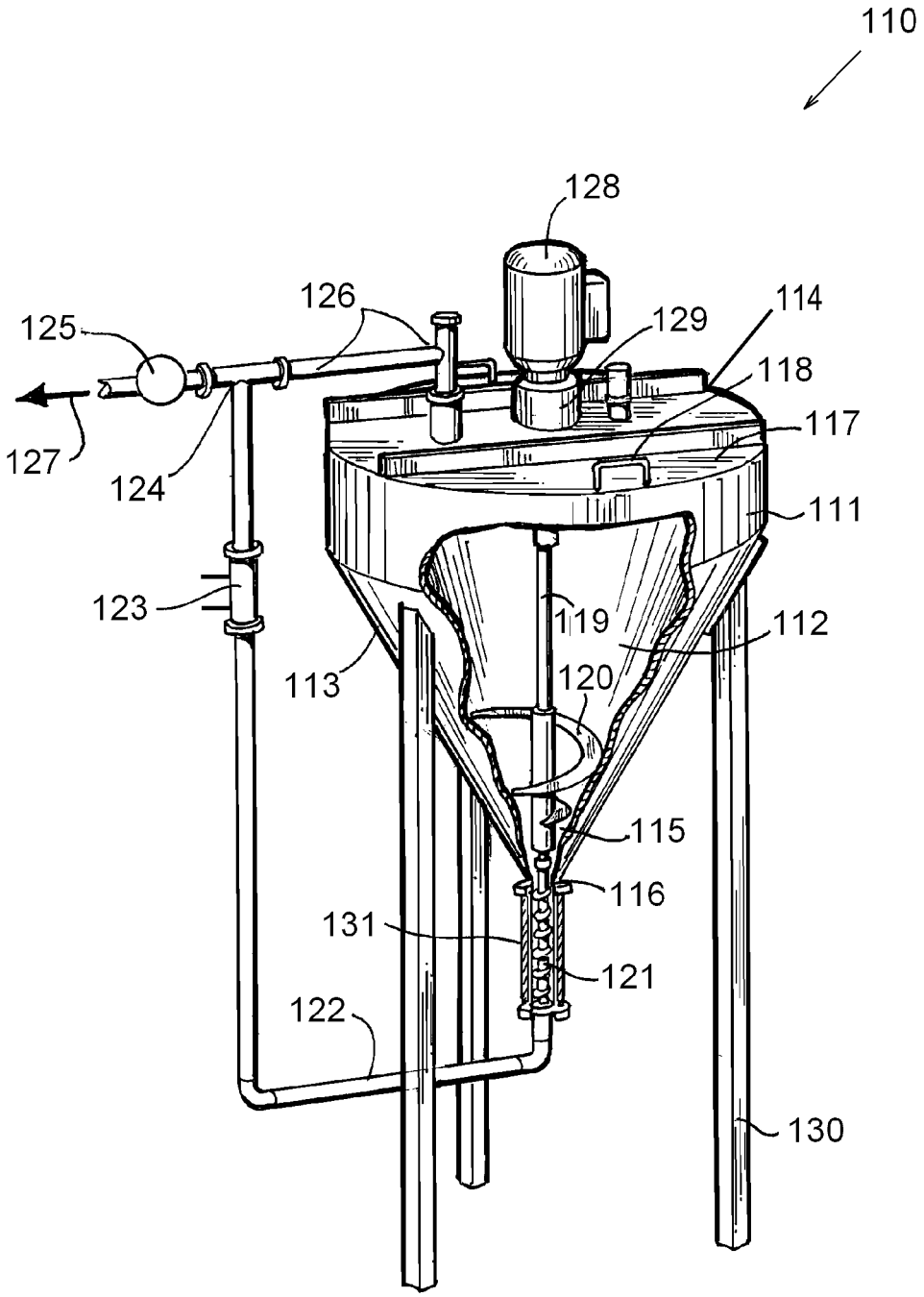
FIG. 12 is an elevation view of another alternate embodiment of the apparatus of the present invention.

FIG. 12 shows another alternate embodiment of the apparatus of the present invention designated generally by the numeral 110. Mixing apparatus 110 and its method contemplate the addition of a viscous and/or polymeric fluid into the well bore of an oil/gas well as part of well control. Such products can include fluid loss control products such as for example "Safe-Link" from MiSwaco (www.miswaco-.com). In FIG. 12, a vessel 111 is provided, supported upon frame or legs 130. Vessel 111 has interior 112. Vessel 111 has a tapered wall or cone 113. Vessel 111 has upper end portion 114 and lower end portion 115. The lower end portion 115 has an outlet 116 which enables fluid to be discharged from vessel 111 interior 112.

A lid or cover 117 is provided on upper end portion of vessel 111. Lid or cover 117 can be hingedly mounted upon upper end portion 114 of vessel 111. Handle 118 on lid or cover 117 enables a user to open or close the vessel 111 such as when adding fluid to vessel interior 112. A drive shaft 119 rotates auger 120. The drive shaft 119 can also rotate screw conveyor 121 or a positive displacement pump. The screw conveyor 121 or positive displacement pump can be contained within a vertical section 131 of discharge piping 122. Air is preferably added to discharge piping 122 such as via air injector or air inlet 123.

Valve 124 is a directional valve that enables fluid to be either recirculated back to vessel 111 are transmitted into an oil well bore. In FIG. 12, flow line 126 is a recirculation flow line that transmits fluid from valve 124 to vessel 111 interior 112. FIG. 12 also illustrates transfer of fluid from valve 124 into a well bore as indicated schematically by the numeral 127. Valve 124 can be operated to send flow to either vessel 111 or to the well bore using an operator 125.

The following is a list of suitable parts and materials for the various elements of the preferred embodiment of the present invention.

PARTS LIST

| PART NO. | DESCRIPTION |
|---|---|
| 10 | dispenser apparatus |
| 11 | vessel |
| 12 | vessel interior |
| 13 | cone/tapered wall |
| 14 | upper end portion |
| 15 | lower end portion |
| 16 | outlet |
| 17 | lid/cover |
| 18 | upper opening |
| 19 | base |
| 20 | forklift tine socket |
| 21 | forklift tine socket |
| 22 | floor |
| 23 | inclined surface |
| 24 | sump |
| 25 | drain |
| 26 | leg |
| 27 | flanged connection |
| 28 | foot |

-continued

PARTS LIST

| PART NO. | DESCRIPTION |
|---|---|
| 29 | frame corner column |
| 30 | frame |
| 31 | fitting |
| 32 | upper beam |
| 33 | inflatable vessel/bladder |
| 34 | interior |
| 35 | material |
| 36 | arrow |
| 37 | upper opening |
| 38 | lower opening |
| 39 | upper edge |
| 40 | lower edge |
| 41 | lower sleeve |
| 42 | upper sleeve |
| 43 | lid |
| 44 | annular flange/shoulder |
| 45 | cylindrical portion |
| 46 | clamp |
| 47 | clamp |
| 48 | clamp |
| 49 | annular wall |
| 50 | air inlet fitting |
| 51 | air inlet |
| 52 | flow line |
| 53 | arrow |
| 54 | arrow |
| 55 | arrow |
| 56 | sleeve |
| 57 | clamp |
| 58 | clamp |
| 59 | flow line/discharge |
| 60 | header |
| 61 | positive displacement pump/screw conveyor |
| 62 | outlet valve |
| 63 | outlet |
| 64 | catch basin |
| 65 | drain |
| 66 | pad eye |
| 67 | opening |
| 70 | brine tank |
| 71 | outlet/valve |
| 72 | flow line |
| 73 | brine inlet |
| 74 | plate |
| 75 | plate |
| 76 | plate |
| 77 | plate |
| 78 | plate |
| 79 | opening |
| 80 | dispensing apparatus |
| 81 | motor drive |
| 82 | drive shaft |
| 83 | auger |
| 84 | outlet |
| 85 | bolts |
| 110 | mixer apparatus |
| 111 | vessel |
| 112 | vessel interior |
| 113 | cone/tapered wall |
| 114 | upper end portion |
| 115 | lower end portion |
| 116 | outlet |
| 117 | lid/cover |
| 118 | handle |
| 119 | drive shaft |
| 120 | auger |
| 121 | screw conveyor/positive displacement pump |
| 122 | discharge pipe |
| 123 | air injector/air inlet |
| 124 | valve |
| 125 | operator |
| 126 | return flow line |
| 127 | arrow - flow to well |
| 128 | motor |
| 129 | gear box |

-continued

PARTS LIST

| PART NO. | DESCRIPTION |
|---|---|
| 130 | frame/legs |
| 131 | vertical section |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of transmitting a viscous polymeric material into an oil well bore, comprising the steps of:

a) providing a frame supporting a vessel, the vessel having an interior, upper and lower end portions, a conically shaped side wall, and an outlet for discharging the material from the vessel;

b) adding the viscous polymeric material to the vessel interior;

c) placing a discharge pipe section having a vertical pipe section in communication with the outlet and at least in part below the vessel, the discharge pipe section being in communication with the outlet;

d) placing a positive displacement pump in the discharge pipe section, said pump transmitting the material from the outlet into the discharge pipe downstream of the vertical pipe section;

e) selectively transmitting the material to either the vessel interior for recirculating or into the well;

f) wherein pressurized air is added to the discharge pipe downstream of the pump of step "d"; and g) wherein an inflatable and deflatable member is placed inside the vessel and around the material in step "b".

2. The method of claim 1 wherein in step "d" the pump includes a screw conveyor.

3. The method of claim 2 wherein the pump includes a drive shaft that rotates the screw conveyor.

4. The method of claim 1 wherein the conically shaped side wall extends to the outlet and the positive displacement pump is placed entirely below the conically shaped side wall.

5. The method of claim 1 wherein in step "b" the viscous material includes a fluid loss control product.

6. The method of claim 1 wherein the viscous material is a viscous polymeric material.

7. The method of claim 1 wherein the vessel gradually tapers downwardly to provide a larger upper portion and a smaller lower portion.

8. A method of transmitting a viscous polymeric material into an oil well bore, comprising the steps of:

a) providing a frame supporting a vessel, the vessel having an interior, upper and lower end portions, a conically shaped side wall that tapers downwardly, an inlet for the intake of material and an outlet for discharging the material from the vessel;

b) adding the viscous polymeric material to the vessel interior, wherein said viscous material is a fluid loss control product;

c) placing a discharge pipe section having a vertical pipe section below the vessel, the discharge pipe section being in communication with the outlet and the well bore;

d) placing a pump in the discharge pipe section, said pump transmitting the material from the outlet into the discharge pipe;

e) wherein the vessel has a liner, and the material of step "b" is surrounded by the liner; and f) transmitting the viscous polymeric material from the discharge pipe into the well bore.

9. The method of claim 8 wherein in step "d" the pump has a drive shaft and the drive shaft extends into the vessel interior.

10. The method of claim 8 wherein in step "d" the pump includes a screw conveyor.

11. The method of claim 8 wherein the conically shaped side wall extends to the outlet and placing the pump entirely below the conically shaped side wall.

12. The method of claim 8 wherein in step "b" the viscous material is a viscous polymeric material.

13. The method of claim 8 further comprising adding compressed air to the vessel.

14. The method of claim 13 wherein the pressurized air urges the liner into contact with the material.

15. The method of claim 8 wherein the vessel gradually tapers downwardly to provide a larger upper portion and a smaller lower portion.

16. A method of transmitting a viscous polymeric material into an oil well bore, comprising the steps of:

a) providing a frame supporting a vessel, the vessel having an interior, upper and lower end portions, a conically shaped side wall that tapers downwardly, an inlet for the intake of material and an outlet for discharging the material from the vessel;

b) adding the viscous polymeric material to the vessel interior, wherein said viscous material is a fluid loss control product;

c) placing a discharge pipe section having a vertical pipe section below the vessel, the discharge pipe section being in communication with the outlet and the well bore;

d) placing a pump in the discharge pipe section, said pump transmitting the material from the outlet into the discharge pipe;

e) wherein the vessel has a liner, and the material of step "b" is surrounded by the liner;

f) transmitting the viscous polymeric material from the discharge pipe into the well bore;

g) further comprising adding compressed air to the vessel;

h) wherein the pressurized air urges the liner into contact with the material; and I) wherein the liner defines an enclosure that connects to the outlet and that extends upwardly from the outlet and completely around the material of step "b".

17. The method of claim 16 wherein the liner connects to said inlet.

18. An apparatus for transmitting a viscous polymeric fluid into an oil well bore, comprising:

a) a frame;

b) said frame supporting a vessel, the vessel having an interior, upper and lower end portions, a conically shaped side wall, and an outlet for discharging the fluid from the vessel;

c) an opening in the vessel for enabling the addition of the viscous polymeric fluid to the vessel interior;

d) an inflatable and deflatable member that is placed inside the vessel and around the viscous polymeric fluid;

e) a discharge pipe section having a vertical pipe section in communication with the outlet and extending at least in part below the vessel, the discharge pipe section being in communication with the outlet;

f) a positive displacement pump in the discharge pipe section, said pump transmitting the fluid from the outlet into the discharge pipe downstream of the vertical pipe section;

g) piping that enables selective transmission of the fluid to either: 1) the vessel interior for recirculating, or 2) into the well; and h) a source of air that includes an air inlet fitting that enables air to be added to the discharge flow line downstream of the outlet.

* * * * *